United States Patent [19]

Maegawa et al.

[11] Patent Number: 4,957,051

[45] Date of Patent: Sep. 18, 1990

[54] AUTOMATIC FITTING APPARATUS FOR HOSE PART OF HALF MADE PANTYHOSE

[75] Inventors: Hiroji Maegawa, Kashiwara; Tatsuro Omuta, Kitakatsuragi, both of Japan

[73] Assignee: Takatori Corporation, Japan

[21] Appl. No.: 333,580

[22] Filed: Apr. 5, 1989

[30] Foreign Application Priority Data

Apr. 11, 1988 [JP] Japan ..... 63-88542

[51] Int. Cl.[5] ..... D05B 21/00

[52] U.S. Cl. ..... 112/121.12; 112/121.15; 223/112

[58] Field of Search ..... 112/121.15, 121.12, 112/121.11, 27, 304, DIG. 3; 223/112

[56] References Cited

U.S. PATENT DOCUMENTS

| | | | |
|---|---|---|---|
| 3,457,885 | 7/1969 | Saltiel | 112/27 |
| 3,527,181 | 9/1970 | Beamon | 112/27 |
| 3,732,832 | 5/1973 | Rosso | 112/27 X |
| 3,777,681 | 12/1973 | Horita | 112/121.15 |
| 3,834,331 | 9/1974 | Raisin | 112/27 |
| 4,133,280 | 1/1979 | Takatori et al. | 112/121.15 X |
| 4,359,956 | 11/1982 | Sakonishi | 112/304 X |

*Primary Examiner*—H. Hampton Hunter

[57] ABSTRACT

An automatic fitting apparatus for holding and forwarding a pair of tubular hose parts of half made pantyhose to a panty part sewing maching includes a forwarding mechanism, a transfer device, movable back and forth to transfer the parts to a table, capable of moving and inclining, and provided with right and left slits for receiving the hose parts, a suction mechanism for opening the welt portions, a drive for moving the table between upright and sideways positions, and a stretching device movable between the table and a clamping mechanism of a panty part sewing machine. The forwarding mechanism may include pairs of flexible plates mounted on a conveyor.

4 Claims, 13 Drawing Sheets

AUTOMATIC FITTING APPARATUS FOR HOSE PART OF HALF MADE PANTYHOSE

BACKGROUND OF THE INVENTION

This invention relates to an automatic fitting apparatus for manipulating hose parts of half made pantyhose, and more particularly, to an automatic fitting apparatus for forwarding a pair of hose parts of half made pantyhose to a panty part sewing machine which seams the welt portions (this part becomes the panty part when seamed) of the hose parts which are usually circular knit. Thus, the automatic apparatus of this invention can be used in a pantyhose production line to integrate a panty part sewing machine with a toe part sewing machine.

Generally, in a pantyhose production line, a pair of hose parts made of filament, and usually circular knit, are first seamed at welt portions disposed side by side by a panty part sewing machine to form a panty part. And then, their respective open ends are seamed by a toe part sewing machine to form a toe part. Thus, a pair of complete pantyhose is manufactured.

After these sewing processes are completed, the pantyhose must still be subjected to such processes as dyeing, folding and packing before they become finished goods.

As apparent from the above, a pair of pantyhose is manufactured by performing two separate sewing processes: panty part and toe part sewing processes. In this respect, an automatic panty part sewing machine (U.S. Pat. No. 3,777,681) and a toe part sewing machine (U.S. Pat. No. 4,133,280) developed by the present Applicants have been widely put to practical use.

In addition, a "sewing process and an apparatus for achieving the same" aimed to reduce the sewing operations of pantyhose and to save labor therefor by integrating the above-described sewing machines have been well known in the hosiery industry as disclosed in EP Pat. No. 126800.

The above-described inventions disclosed in EP Pat. No. 126800 have outstanding characteristics such as reducing the number of workers from two to one. However, a problem still remains in that laborious work is still required by each worker in the workshop to fit welt portions of tubular hose, after opening the welt portions by hand, to clamping means (comprising a pair of right and left clamping plates at upper and lower locations) of a panty part sewing machine.

Moreover, this fitting operation must be conducted in an exact manner and requires much time, because it includes evenly positioning upper hem portions of welt parts and garter line parts (a line defined between panty part and leg part), which results in a reduction in efficiency.

SUMMARY OF THE INVENTION

Accordingly, a first object of the invention is to provide an automatic fitting apparatus which easily and effectively forwards hose parts of pantyhose to a panty part sewing machine so as to save man power.

A second object of the invention is to provide an automatic fitting apparatus which forwards the hose parts to a panty part sewing machine under a condition in which upper hem portions of welt parts and garter line parts of the hose parts are evenly positioned in order that superior quality pantyhose are obtained.

A third object of the invention is to provide an automatic fitting machine which allows one operator to forward hose parts to a plurality of panty sewing machines.

DETAILED DESCRIPTION OF THE PREFERRED EMBODIMENTS

First, the embodiment shown in FIGS. 1 through 12 will be described.

Figure 1:
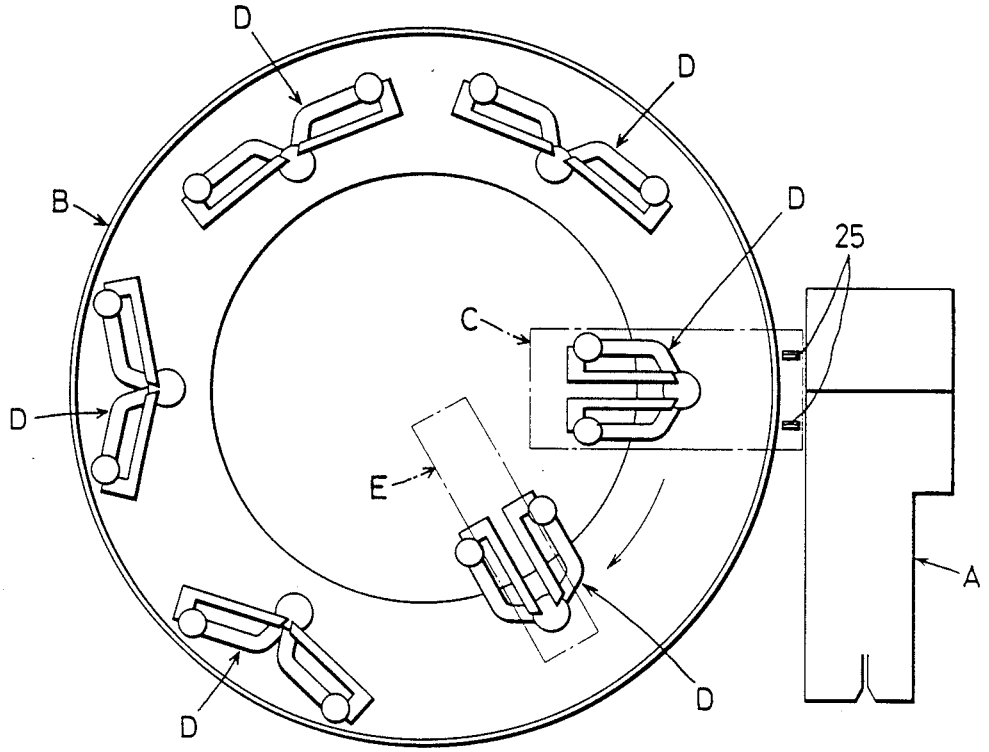
FIG. 1 is a schematic plan view of the automatic fitting apparatus according to the present invention.

FIG. 1 is a schematic illustration of an apparatus according to the present invention in which A is an essential part of the invention, B is an automatic panty part sewing machine, C is a stretching means, D is a clamping means and E is a positioning means.

In FIGS. 1 through 6, an automatic fitting apparatus A is provided with a pair of right and left guide plates 1, 2 secured to a frame (not shown) and the space between plates 1 and 2 defines a carrier slit 3.

On guide plate 2 a pair of pulleys 4, 4 are rotatably mounted and around which pulleys an endless carrier belt 5 is reeved with a run thereof facing slit 3.

Figure 2:
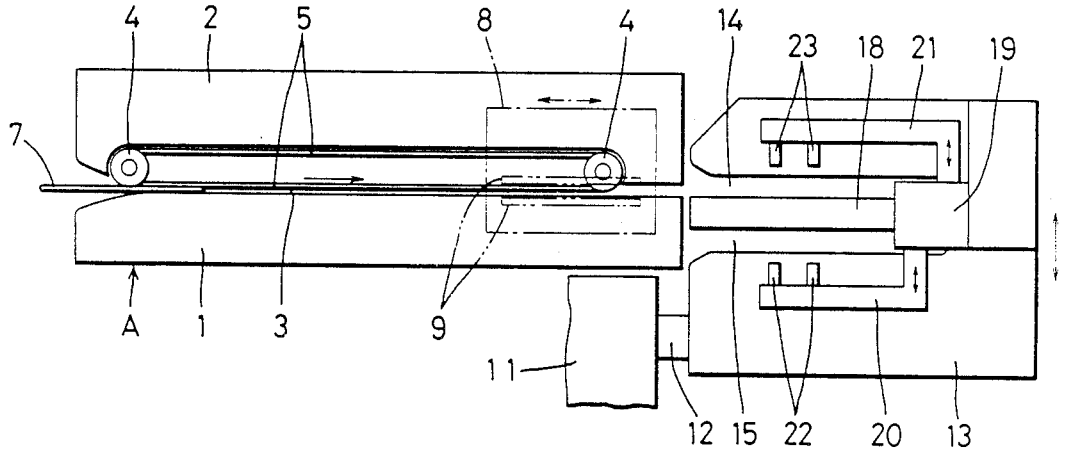
FIG. 2 is a plan view of an essential part of the automatic fitting apparatus according to the present invention.
Figure 3:
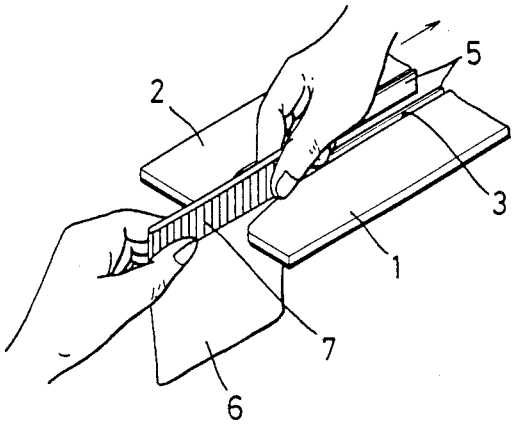
FIGS. 3 through 6 are perspective views of the various portions of the essential part of the automatic fitting apparatus.
Figure 5:
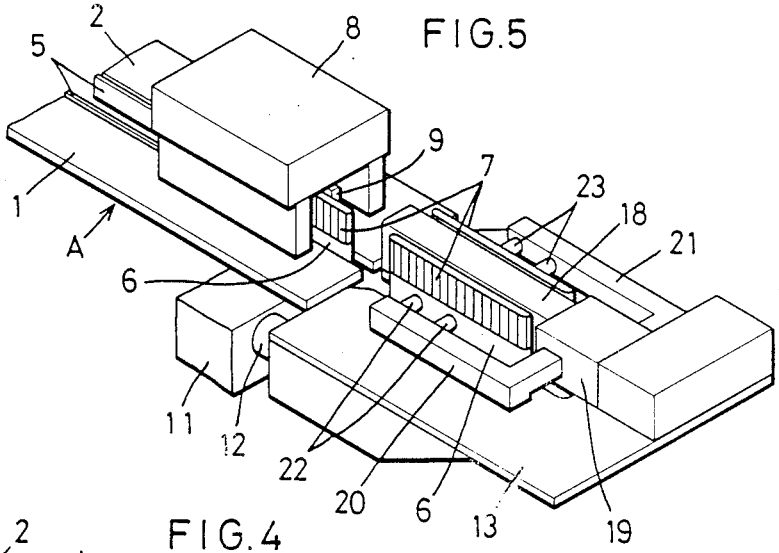

One of the pulleys 4, 4 is provided with driving means consisting of a motor and speed reducer for driving belt 5 in the direction of the arrow shown in FIG. 2 when necessary. The forwarding mechanism is so constructed that when welt portion 7 is inserted into the slit 3 in a flattened state as shown in FIG. 3, hose part 6 is transferred in a suspended manner to the rear of slit 3 by means of the belt 5 running in the direction of the arrow shown in FIG. 2.

Above the carrier slit 3 is disposed moving member 8 moving back and forth in the direction of the arrows shown in FIG. 2. On the underside of moving member 8 is a transfer device 9 for transferring to a moving table 13 the welt portion 7 being carried by the belt 5 by either exerting suction on the side of welt portion 7 or by gripping the welt portion 7.

Figure 4:
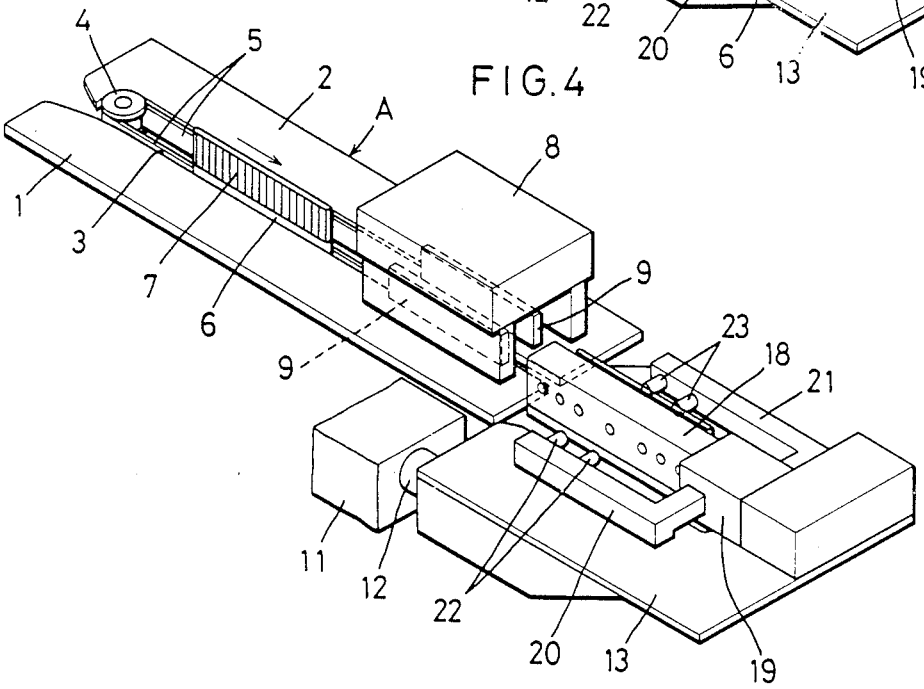
Figure 6:
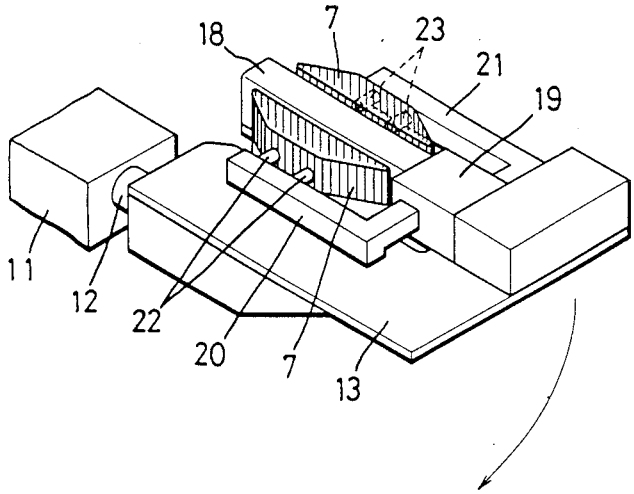

The moving table 13 is not only moved by moving block 11 in the direction of the arrows as shown in FIG. 2, but also rotates about shaft 12. Furthermore, a pair of right and left receiving slits 14, 15 are defined in the table 13, between which slits is disposed a square tubular suction member 18. Both sides of suction member 18, as shown in FIG. 4, have a plurality of suction holes therein.

The rear part of the suction member 18 is fixed to a vacuum table 19. A respective movable suction device 20, 21 is fixed on each side of vacuum table 19.

The suction devices 20, 21 extend along both sides of member 18, the inner side of the devices 20, 21 being provided with a plurality of projecting suction portions 22, 23 opposing member 18.

When welt portion 7 of hose part 6 enters slit 14, held by the transfer device 9 of the moving member 8, with the table 13 horizontal and the receiving slit 14 aligned with carrier slit 3, the side surface of welt portion 7 is sucked to the suction holes of suction member 18, after which transfer device 9 releases the welt portion 7 and the moving member 8 is brought back to its original position.

Transfer device 9 now at its original position again returns to the table 13 with another welt portion 7. At this moment, slit 15 of table 13 is aligned with slit 3 so that welt portion 7 is led into slit 15 to be sucked by suction member 18. The transfer device 9 again returns to its original position after having released the welt portion.

In this way, with a respective welt portion being sucked to each side of suction member 18, when sucking devices 20, 21 approach the welt portions 7 at both sides of suction member 18 and the suction portions 22, 23 thereof contact the welt portions, a sucking operation starts and suction devices 20, 21 move away from the member 18 thereby causing the openings of the welt portions to be widened.

Figure 7:
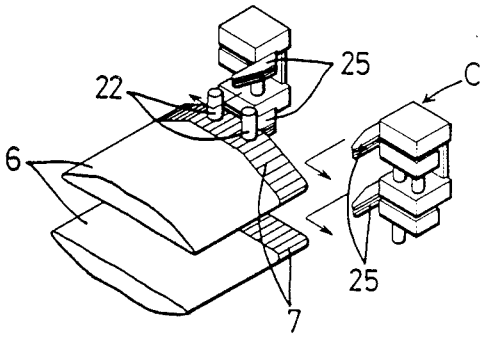
FIG. 7 is a perspective view of the portion of the essential part of the present invention and a stretching means of the automatic fitting apparatus showing the interaction therebetween.

As described above, with both welt portions 7 being widened, the table 13 rotate 90° about shaft 12 causing each widened welt portion to be turned sideways so as to face claws 25 of stretching means C (See FIG. 7).

Then, two pairs of claws 25 associated with a welt portion and comprising upper and lower and right and left claws provided on widening means C, are inserted into a respective welt portion 7 oriented sideways.

Figure 8:
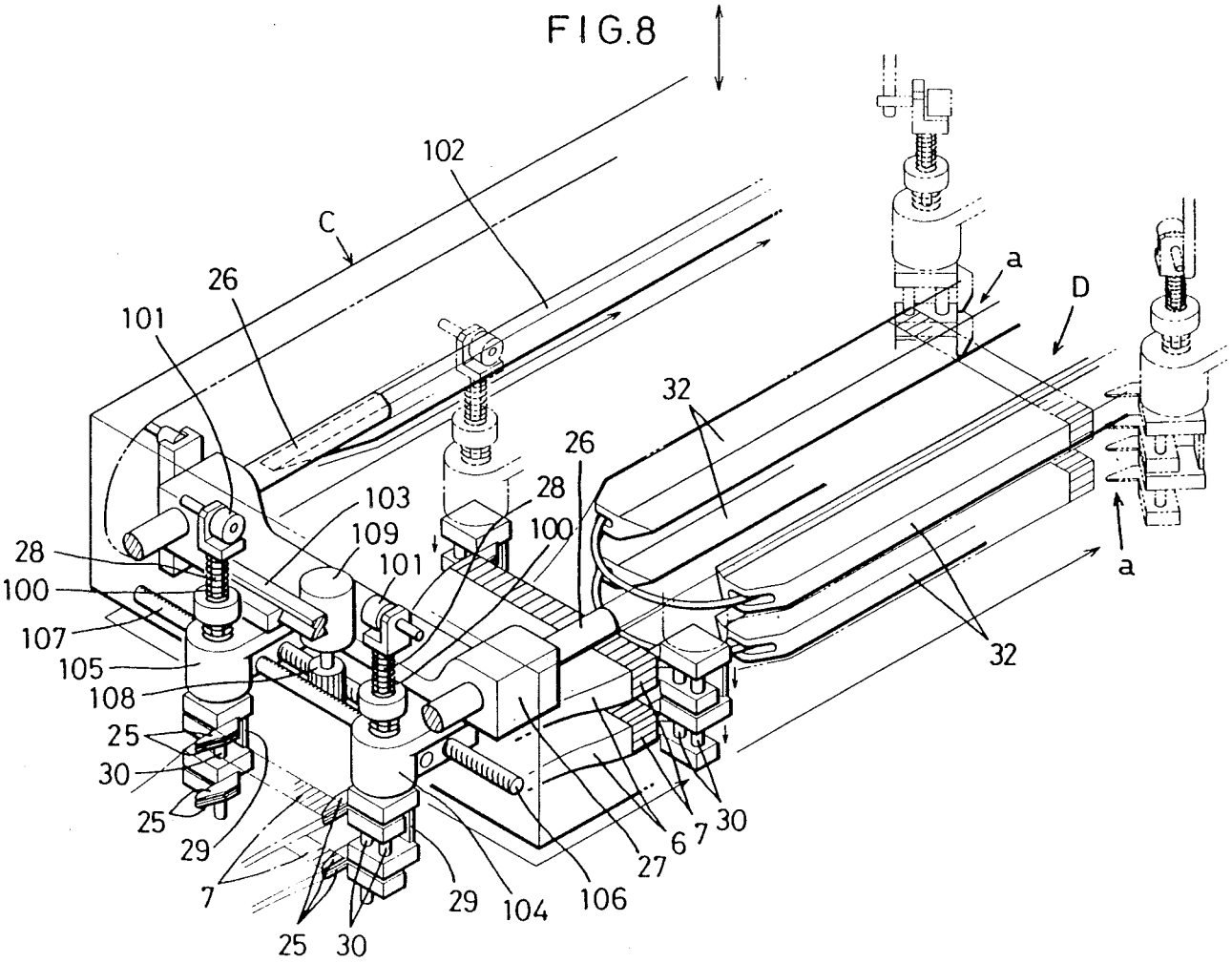
FIG. 8 is an enlarged perspective view in detail of the stretching means.

As shown in FIG. 8, each claw 25 is fixed to a rotary shaft 28 capable of moving up and down in the vertical direction through a vertical through hole of a slide bracket 104 or 105 provided under a moving frame 27 moving back and forth along guide 26. Each shaft 28 is provided with two pairs of claws 25, a respective pair located at upper and lower locations. The uppermost claw 25 and third claw 25 from the top are fixed at their rear parts to shaft 28 by means of connecting plate 29, and the second claw 25 from the top and the lowermost claw 25 are fixed to a pair of right and left shafts 30 capable of moving up and down. Up-and-down movement of the second claw from the top and the lowermost claw with respect to the uppermost claw and the third claw from the top causes the pairs of claws 25 to open and close.

The pairs of claws are usually biased to a closed position due to springs 100. When the moving frame 27 moves from the position shown by a solid line to the position shown by a dashed line (immediately before each clamping plate of clamping means D) in FIG. 8, a roller 101 provided at the upper end of each shaft 28 comes into contact with the undersurface of a cam plate 102 so that shaft 28 is lowered against the force exerted by spring 100 whereby the pairs of claws open. Moreover, the claws are constructed in such a manner as to open and close laterally. That is, the undersurface of moving frame 27 is provided with a guide rail 103 along which the slide brackets 104, 105 can move.

In addition, two parallel racks 106, 107 pass between slide brackets 104, 105. One end of rack 107 is fixed to the bracket 104 while the other rack 106 and slide bracket 104 are not fixed thereto. In the same way, one end of rack 106 is fixed to bracket 105 while slide bracket 105 and rack 107 are not.

A pinion 108 is positioned between racks 106, 107 in such an engaged manner as to be rotatable in either direction by motor 109. Accordingly, when the pinion is rotated clockwise (in FIG. 8), slide brackets 104, 105 are moved toward each other, while when rotated counterclockwise, the brackets are moved away from each other, thereby causing each of right and left pairs of claws 25 to laterally open and close. Usually, the right and left pairs of claws are in a laterally closed position.

Figure 9A:
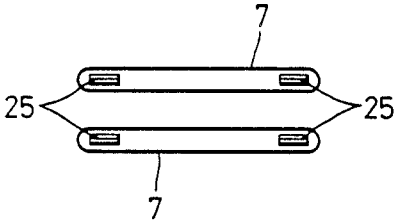
FIGS. 9(A), (B), (C) are front views illustrating the operation of the stretching means.

Each claw 25 of stretching means C described above moves towards the upper and lower welt portions 7 maintained open and oriented sideways as shown in FIG. 7, and enters a welt portion as shown by a solid line in FIG. 8. (FIG. 9A)

Figure 9B:
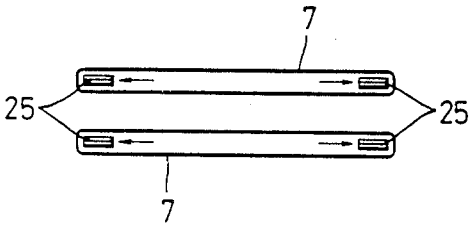

Next, when slide brackets 104, 105 are forced away from each other by means of pinion 108 and racks 106, 107 under the action of reversely driven motor 109, the right and left pairs of claws are spread laterally from a closed position to retain each welt portion thereon (FIG. 9B).

Figure 9C:
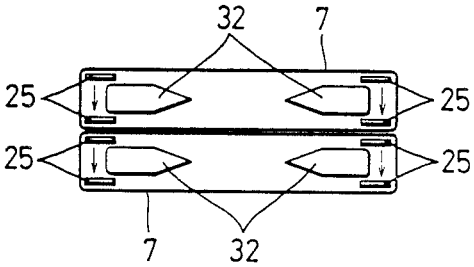

Then, when moving frame 27 moves towards clamping means D to cause roller 101 to contact cam 102, the second claws from the top and the lowermost claws are lowered to spread welt portions 7 in a longitudinal direction (FIG. 9C). Travelling in this condition, welt portions 7 are fitted over clamping plates 32 so that the welt portions are delivered to clamping means D from claws 25.

Afterwards, each claw 25 is turned as shown by a chain line (at the rear of each clamping plate 32 of clamping means D) in FIG. 8 to withdraw from welt portion 7. After elevating, each claw 25 returns to its original position so as to be ready for the next operation. After stretching means C is withdrawn from welt portions 7 and is raised, clamping means D which is adjacent widening means C in FIG. 1 moves with the welt portions to a position adjacent positioning means E.

Figure 10:
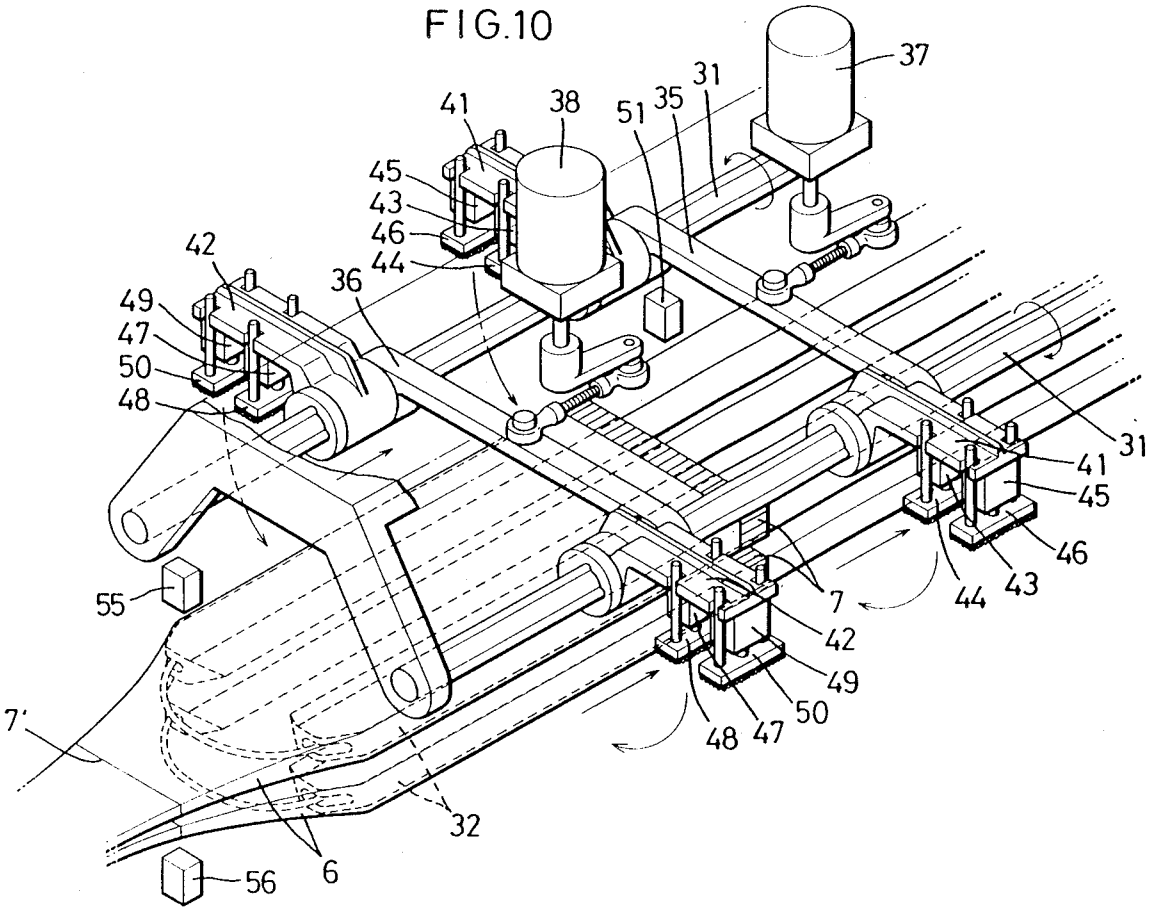
FIG. 10 is an enlarged perspective view of positioning means of the fitting apparatus according to the present invention.
Figure 11:
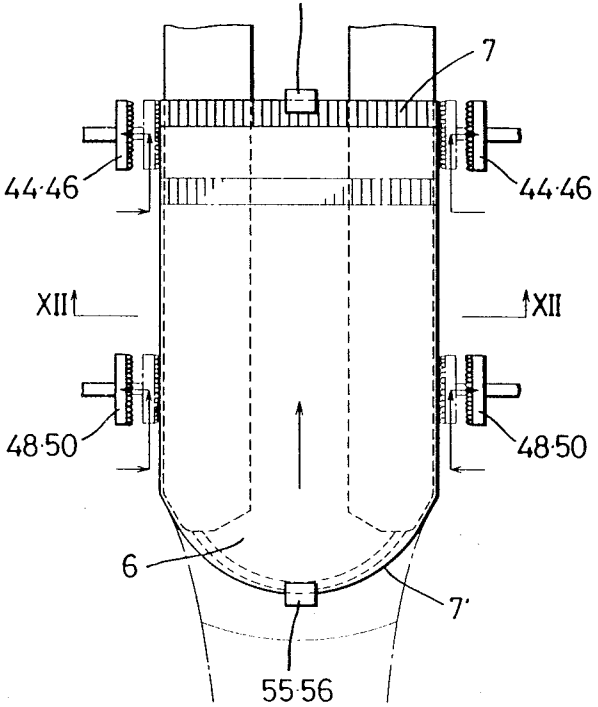
FIG. 11 is a plan view illustrating the operation of the positioning means.

The above-described positioning means is provided with moving frames 35, 36, which move independently along a pair of right and left guide shafts 31, as shown in FIGS. 10 and 11. Those frames are driven independently by separate motors 37, 38 by means of a crankshaft mechanism and the like.

Both ends of the moving frames are provided with levers 41, 42, respectively, which rotate about the guide shafts 31. A groove axially formed in a shaft of each of the levers 41, 42 receives guide shaft 31, whereby the levers rotate concurrently with the rotation of the shafts 31.

To the right and left front levers 41 are fixed a pair of upper and lower actuators 43, 45 such as air cylinders or the like for driving caps 44, 46 back and forth independently. Likewise, to the right and left rear levers 42 are fixed a pair of upper and lower actuators 47, 48 for driving caps 48, 50 back and forth independently.

These caps 44, 46, 48 and 50 are made of material, such as rubber, having a large coefficient of friction and causing the least damage to hose part 6. Their contact surfaces that engage hose part 6 are unevenly formed.

Numerals 51, 52 designate sensors for detecting hem parts of welt portions 7 and 55, 56 designate additional sensors for detecting garter line 7. These sensors are secured at fixed positions relative to the positioning means E.

Each of these sensors independently controls the above-described motors 37, 38 and each actuator 43, 45, 47 and 49. The positioning means E operates as follows: when clamping plates 32 with welt portions 7 stop, each guide shaft 31 is rotated by driving means (not shown) to cause each lever 41, 42 to rotate downwardly.

Figure 12A:
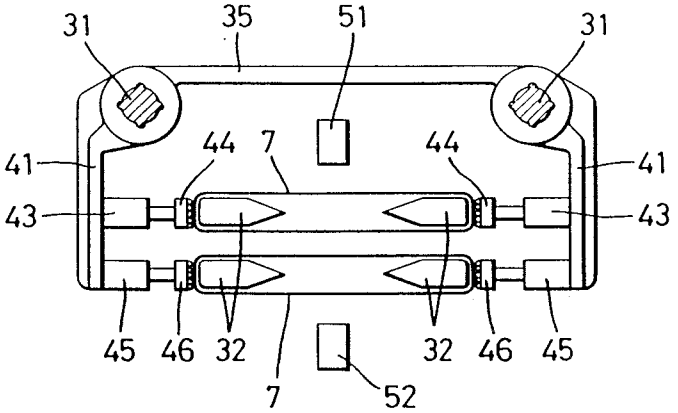
FIGS. 12(A) and (B) are longitudinal front views taken along line XII—XII of FIG. 11 illustrating the positioning of the welt portions by the positioning means.

Then, as shown in FIG. 12(A), upper actuators 43 and lower actuators 45 operate at the same time so that right and left caps 44, 46 are pressed against the upper and lower welt portions.

Figure 12B:
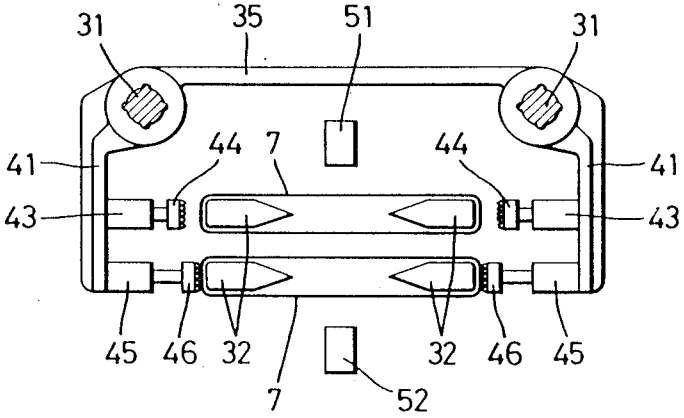

In this case, for example, if sensors 51 detect the hem part of welt portion 7, upper actuator 43 is released as shown in FIG. 12(B), while if lower sensor 52 has not detected the same it remains actuated.

In short, upper actuator 43 and lower one 45 act concurrently to cause caps 44, 46 to press against upper and lower welt portions 7. Detection by sensors 51, 52 leads to the independent release of each actuator. And, moving frame 35 is returned to its original position by motor 37.

Through such actions, the hem parts of the upper and lower welt portions are aligned. Likewise, rear motor 38 and upper and lower actuators 47, 49 of the right and left levers 42 are moved by actuators 43, 45 to the place where garter line parts 7' are detected by sensors 55, 56.

As described above, after the upper and lower welt portions and garter line parts 7' have been correctly fitted to each clamping plate 32 of the clamping means D. The means D moves to facilitate subsequent processing of each hose part 6.

Figure 13:
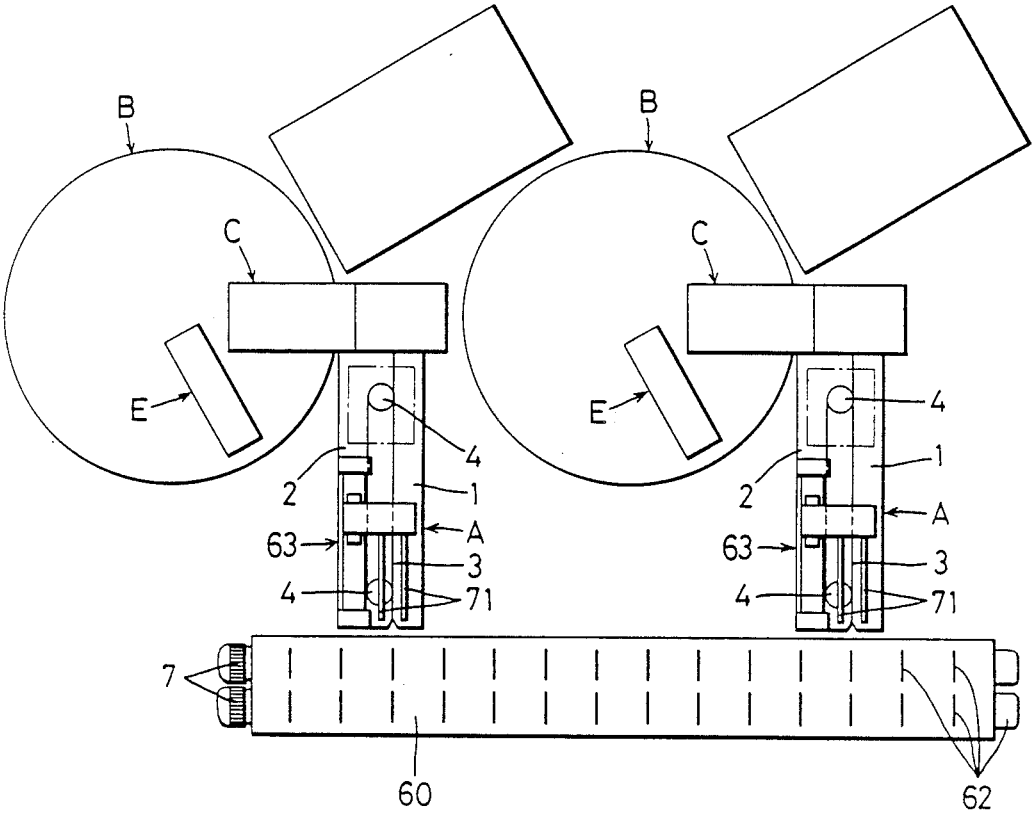
FIG. 13 is a plan view of an example of a system in which a plurality of automatic fitting apparatuses according to the present invention are employed.

FIG. 13 shows a system in which a plurality of automatic fitting apparatuses A are employed. For each apparatus A, an automatic panty part sewing machine B, stretching means C, clamping means D and positioning means E is provided in the manner described above.

Figure 14:
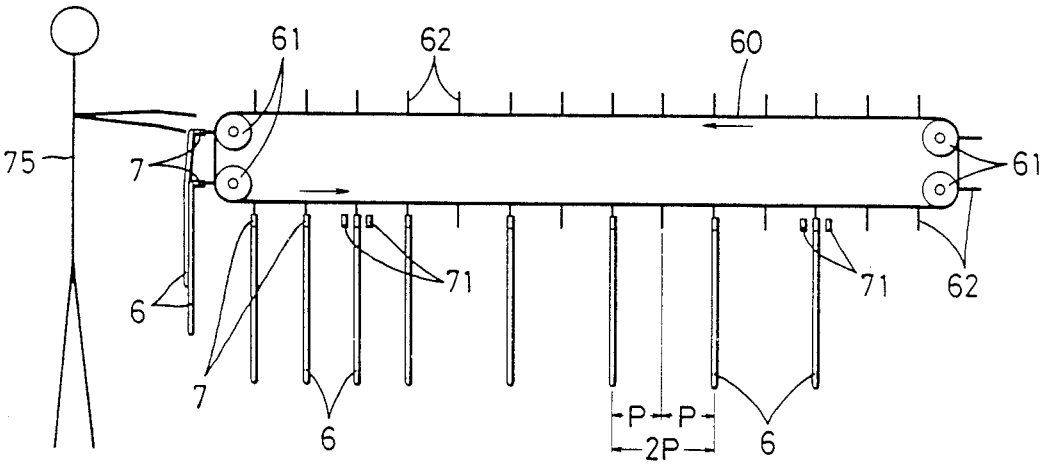
FIG. 14 is a side elevational view of a conveyor belt employed in the system shown in FIG. 13.

To the side of each apparatus A is disposed conveyor belt 60. As shown in FIG. 14, the belt 60 is intermittently driven in the direction of the arrows with upper and lower pulleys 61 supporting link portions. To the outside of this belt is secured a pair of right and left transferring plates 62 at regular intervals.

Figure 15:
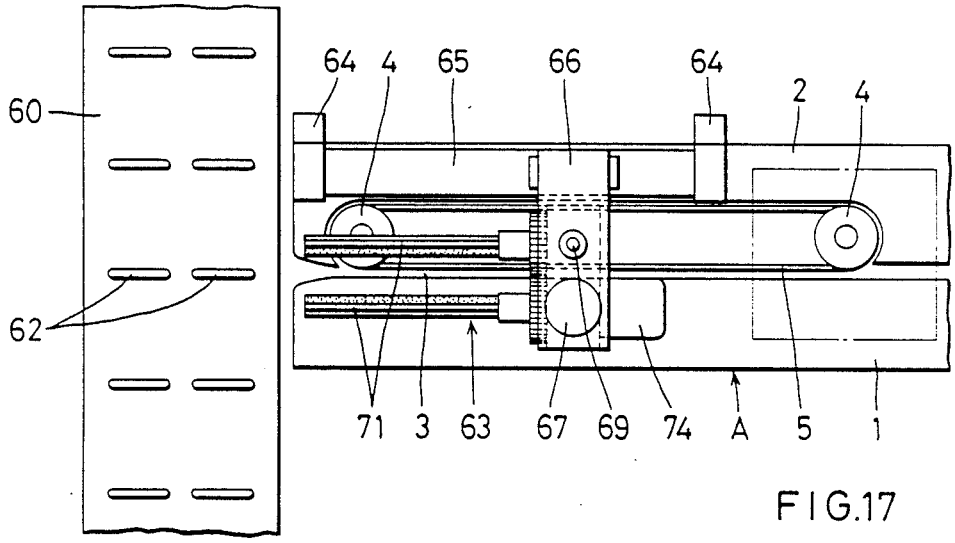
FIG. 15 is a partially cutaway plan view of the automatic fitting apparatus and the conveyor belt disposed in the system shown in FIG. 13.
Figure 17:
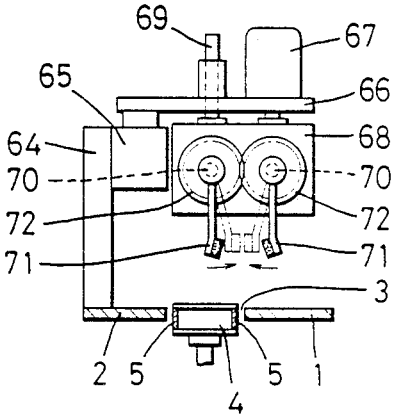
FIG. 17 is a vertical sectional view taken along line XVII—XVII in FIG. 16.
Figure 16:
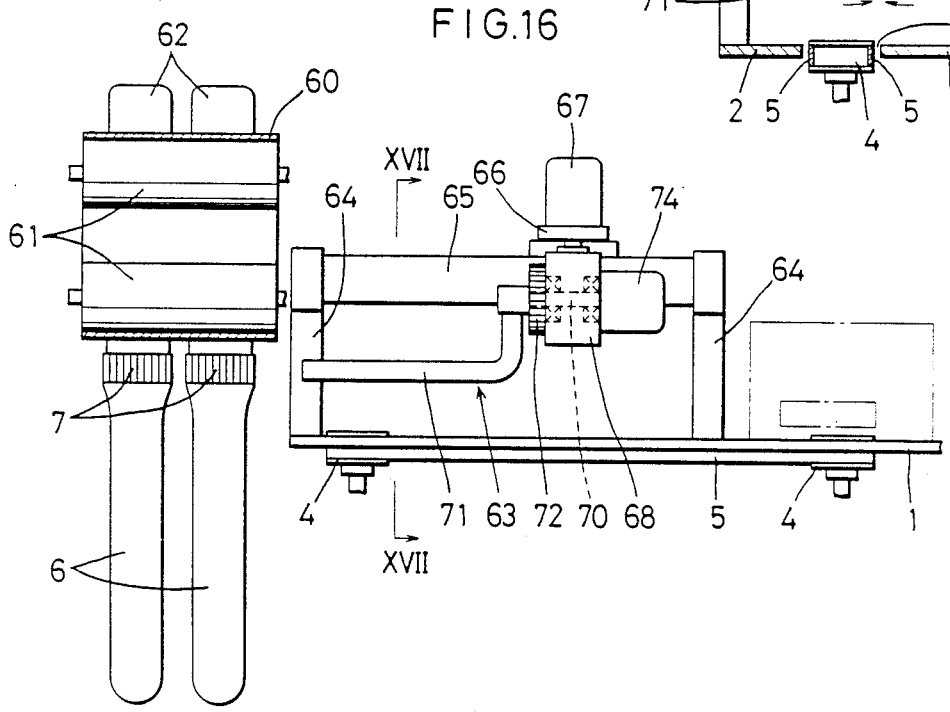
FIG. 16 is a side view of the apparatus and conveyor belt shown in FIG. 15.
Figure 22:
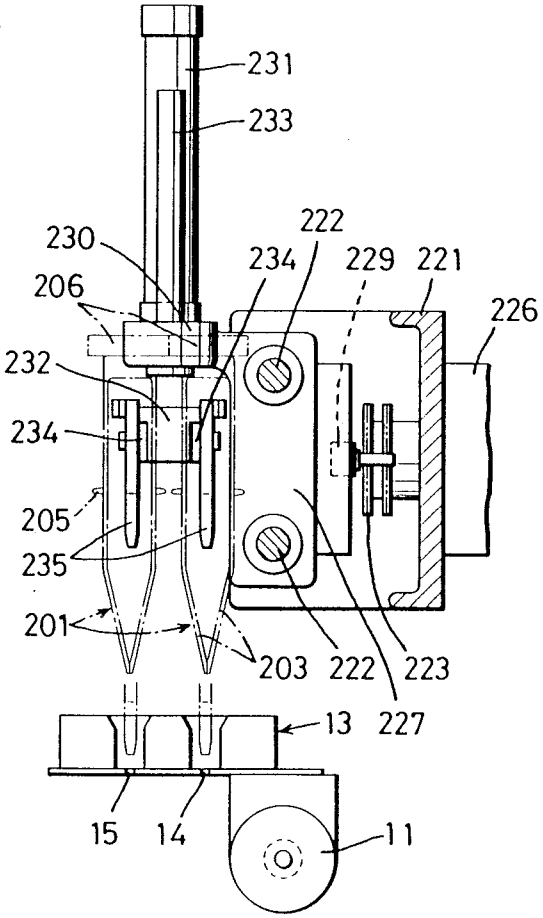
FIG. 22 is a plan view of the forwarding mechanism and the transfer device shown in FIG. 21.

On guide plate 2 of each fitting apparatus A is provided a transfer means 63, as shown in FIGS. 15 through 17.

The transfer means 63 supports rodless cylinder 65 on a bracket 64. A sliding body 66 is moved back and forth by each cylinder 65. Cylinder 67 is fixed to the sliding body 66. To an up-and-down moving body 68 driven by the cylinder 67 is fixed a guide rod 69, which is inserted into a vertical guide of body 66, so as to function as a detent against and to guide the body up and down in the vertical direction. To this body 68 are provided a pair of rotary shafts 70 having end portions to which respective clamping devices 71 are fixed.

Gears 72 are each fixed to a respective rotary shaft 70 and are interlocked to cause both clamping devices 71 to open and close when only one rotary shaft 70 is driven by rotary actuator 74 fixed to body 68.

The clamping device 71 is L-shaped and extends toward conveyor belt 60 as shown in FIG. 16.

The outside of the device 71 is covered with rubber. In this example, at one end of conveyor belt 60 is positioned an operator 75 to fix welt portions 7 over the right and left carrier plates 62.

Hose part 6 thus supported in a dangling manner travels with welt portion 7 being held as shown in FIG. 14. Where there are two fitting apparatuses A as in the shown system, belt 60 is moved intermittently with a pitch twice as long as pitch P, that is 2P, of carrier plate 62.

Belt 60 is made to stop so that each carrier plate 62 with the hose part 6 dangling therefrom is positioned immediately before a slit 3 of a fitting apparatus A.

Because each up-and-down moving body 68 on apparatus A is in an elevated position, each clamping device 71 is opposed to respective welt portions 7 and are open as shown in FIGS. 13, 14, 17.

Figure 18:
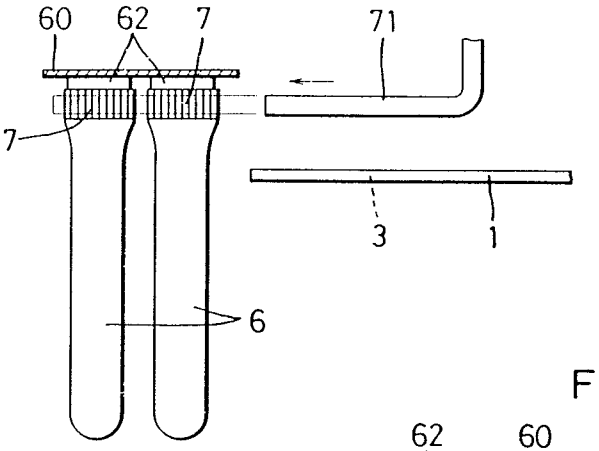

Next, rodless cylinder 65 advances sliding body 66, thereby positioning the clamping devices 71 at both sides of the front and rear welt portions as shown by the dashed line in FIG. 18. Under this condition, rotary actuator 74 rotates each gear 72 to close the right and left clamping devices 71 so that welt portions 7 of a pair of hose parts 6 are held between the clamping devices 71.

Figure 19:
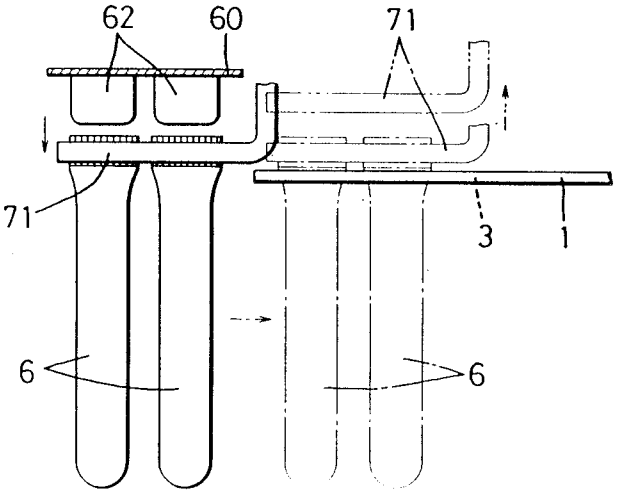
FIGS. 18, 19 are side views illustrating the operation of a clamping device of the apparatus shown in FIGS. 16 and 17.

Under this condition, each cylinder 67 is actuated to lower each body 68 thereby completely releasing from carrier plates 62 hose part 6, held by clamping devices 71 as shown in FIG. 19.

Next, when each sliding body 66 is retracted by the rodless cylinder 65, hose parts 6 held by the clamping devices is inserted into each slit 3 of each apparatus A, as shown by the dashed line in FIG. 19.

After each hose part 6 is inserted into each slit 3, rotary actuator 74 causes each clamping device 71 to open. Then, the cylinder 67 elevates body 68 to release the clamping devices 71 from hose part 6 in slit 3.

Afterwards, each automatic fitting apparatus carries out the operation described in connection with FIGS. 4 through 12. The hose parts 6 disposed on a carrier plate so as to be removed by a respective apparatus A from each belt 60 under the above-described operation shown in FIGS. 18 and 19, are spaced apart by a pitch 2P as shown in FIG. 14.

Since the belt has a pitch P, a carrier plate 62 having hose part 6 dangling therefrom is always aligned with a slit 3 of a respective fitting apparatus A. After passing by the second apparatus A, the carrier plates 62 are all free of hose parts 6 and return to the operator 75.

This example describes a system in which two automatic fitting apparatuses A are employed; however, more than two apparatuses may be used. In such cases, the travelling pitch of the hose parts should be: length obtained by "multiplying the pitch of carrier plates 62 by the number of fitting apparatuses A".

Next, a second embodiment of an automatic fitting apparatus is shown in FIGS. 20 through 24 comprising a forwarding mechanism having holders for holding hose parts 6, and a transfer device 9 for transferring pairs of hose parts from the forwarding mechanism to a table 13 capable of moving and inclining.

The forwarding mechanism includes holders 201 for retaining welt portions 7 of hose parts 6 and a conveyor 202 from which a plurality of holders 201 are suspended. As shown in FIGS. 20 through 24, each holder 201 comprises a pair of flexible plates 203, 203 opposing each other and defining a space therebetween below upper connecting point 204. Lower ends of the plates 203, 203 have an arcuate shape and are inclined toward each other so that the placing of a welt portion 7 over a pair of plates 203, 203 can be easily conducted. In addition, projections 205 are provided at the outer surface of plates 203 in such a manner as to position the upper part of welt portion 7 when disposed over plates 203, 203.

At the center of the upper surface of connecting part 204 is provided a square guide 206 from which a shaft 207 projects, and bearings 208, 208 are fixed thereto at upper and lower locations.

Figure 21:
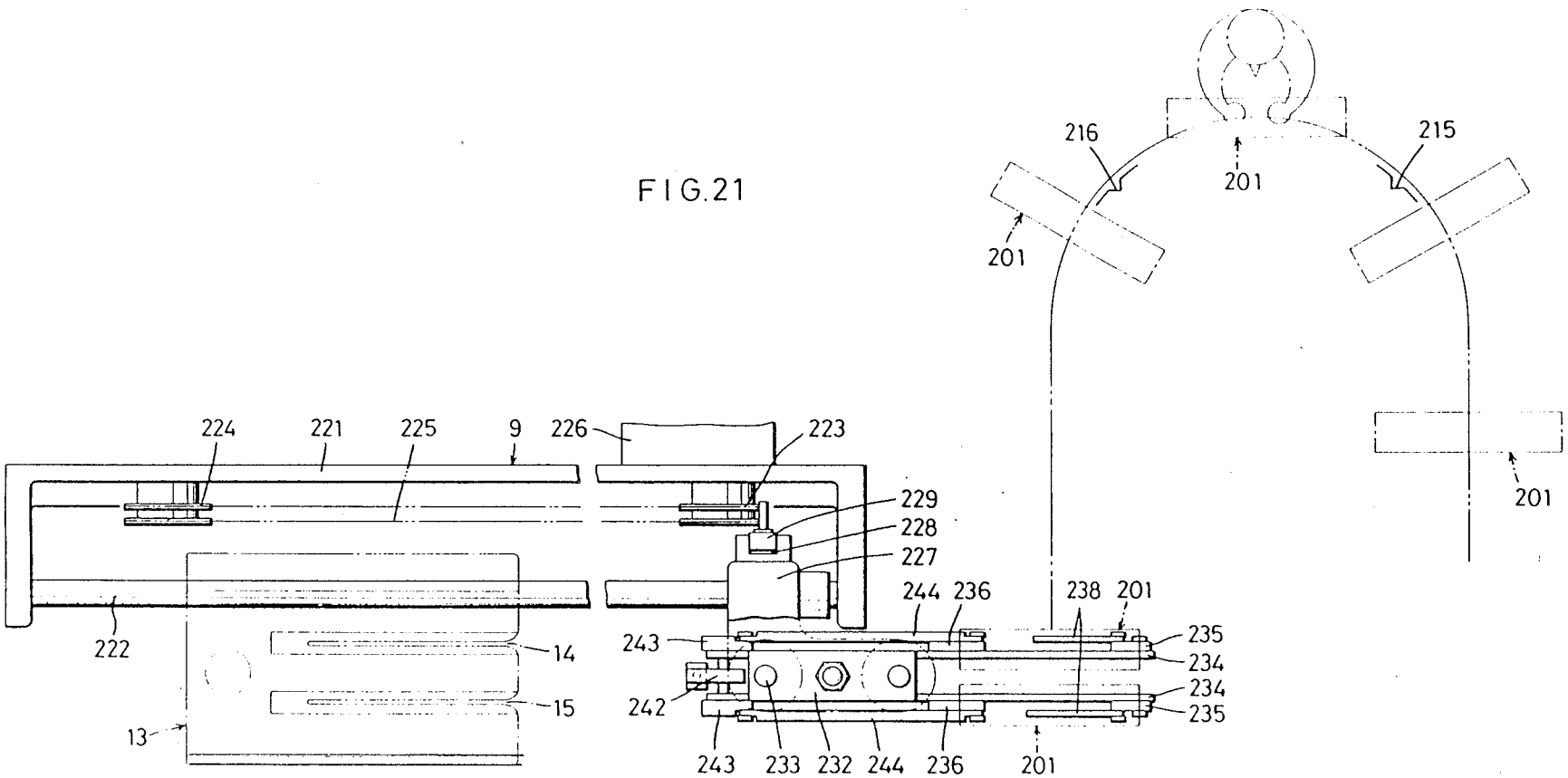
FIG. 21 is a plan view of the same forwarding mechanism and the transfer device.

Concave grooves 210, 210 are defined along an external surface of a conveyor body 209 of conveyor 202 to guide bearings 208, 208. And, a guide groove 210 guides the square guide 206. Belt 213 has the underside thereof supported by supporting plates 212 at a position located outside of bearings 208, 208. The belt 213 is urged by a spring 214 so that when it starts moving the bearings 208, 208 rotate concurrently with such movement thereby causing holders 201 to move in the direction in which belt 213 moves. While moving around, guide 206 of holder 201 comes so close to guide groove 211 that the holders nearly cease from rotating so as to remain in position while travelling in the moving direction. Also, just before and after a fitting station, notches 215, 216 are defined in guide groove 211 as shown in FIG. 21 so that plates 203 face an operator so that the fitting operation can smoothly be conducted.

Figure 23:
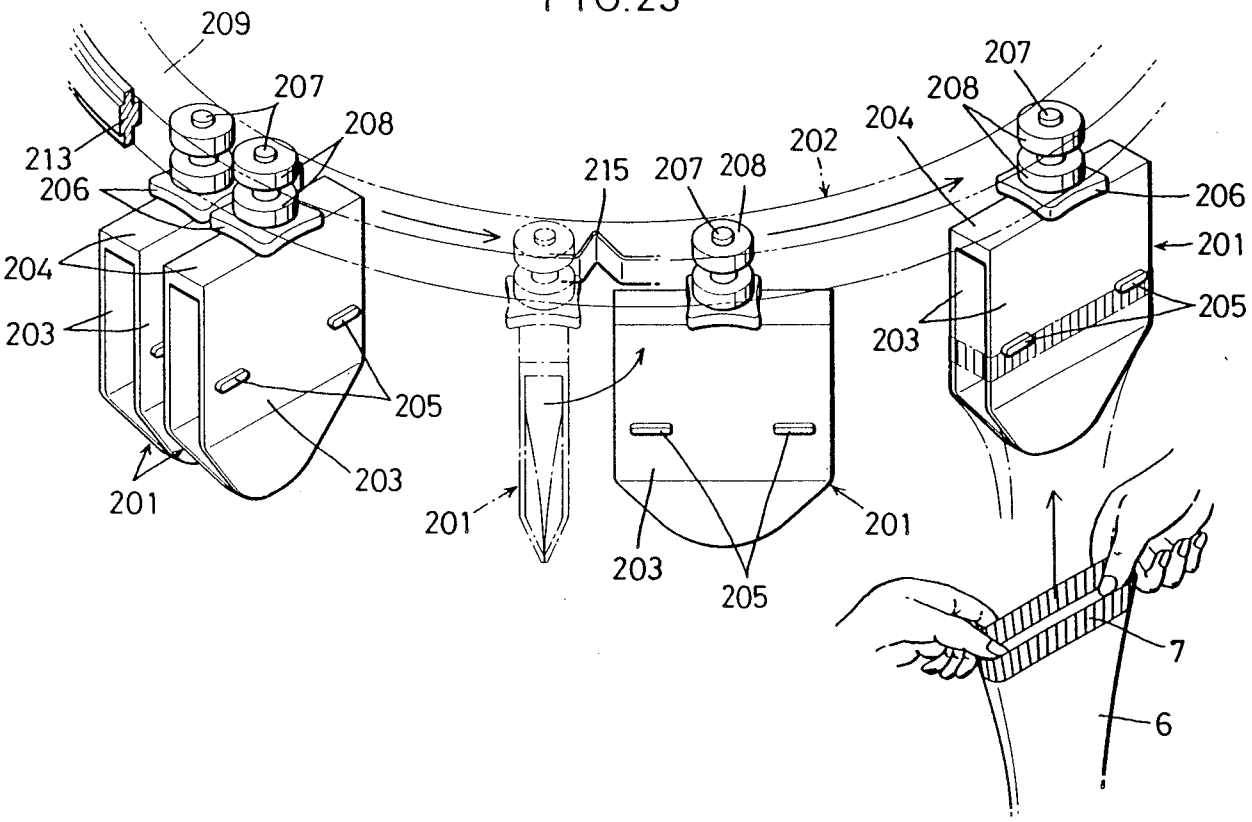
FIG. 23 is a front view of essential parts of the forwarding mechanism.

As shown in FIG. 23, holders 201 advancing to the fitting station are rotated 90° due to notch 215 in which the corners of square guides 206 are caught. Likewise, the holders 201 fitted with a hose part are rotated back 90° and return to their original orientation due to the cooperation of notch 216 and guide 206. Transfer device 9 is so disposed between the holders 201, which stop at a predetermined position at the transfer device, and table 13, that it receives two hose parts 6 at the same time from two holders 201, 201 to deliver the hose parts to table 13. This table capable of moving and inclining has the same structure as that shown in FIGS. 2 through 6.

In transfer device 9, two guide shafts 22 disposed one above the other extend horizontally in front of fixed bracket 221 and parallel to each other. An endless chain 225 is wound around sprockets 223, 224 fixed to both ends of fixed bracket 221 at the front part thereof, and sprocket 223 is driven by a motor 226.

A running body 227 supported by upper and lower guide shafts 222, 222 has, at the rear surface side thereof, a longitudinal groove 228 into which guide roller 229, secured to endless chain 225, extends, whereby the running body is moved back and forth along guide shafts 222, 222 by the running of the chain 225 about sprockets 223, 224.

A cylinder 231 is fixed on flat block 230 projecting above running body 227. Just under this flat block is posed a square body 232 which is movable in the vertical direction by means of the cylinder 231 and guide shafts 233, 233.

A pair of plates 234, 234 are respectively fixed at side surfaces of up-and-down movable body 232 and extend horizontally so as to project beyond running body 227. Pairs of claws 235, 236 are pivotally attached to plates 234, 234 at the sides thereof that do not face each other.

More specifically, the pairs of claws 235, 236 are pivotally fixed to plates 234 by pivots 237. The upper end of each claw 235 and the middle part of a respective claw 236 are connected by a rod 238 in order that swinging movement imparted to one claw causes both claws 235, 236 to pivot downwardly from an elevated position facing each other.

At the rear end of body 232, a piston rod of cylinder 240 mounted to bracket 239 and an arm 242 extending from a shaft 241 pivoted at the rear end of body 232 are pivotally connected. A respective arm 243 secured to each end of shaft 241 and the upper end of a respective claw 236 are connected by connecting rod 244. When cylinder 240 is in a retracted position as shown by a solid line in FIG. 20, a pair of claws 235, 236 extend downward and when the cylinder 240 is extended claws 235, 236 are swung upward so that the claws are positioned as shown by the dashed lines in FIG. 20.

As is seen in FIG. 21, just when the running body 227 advances to the right side of the apparatus in FIG. 21 and while body 232 is in an elevated position, the plates 234, 234 are disposed at delivery positions of hose part 6 in the forwarding mechanism. In the forwarding mechanism, two holders 201, 201 are stopped to await the arrival of the plates at this delivery position. Accordingly, a positional relationship is established in which plates 234, 234 at the delivery position are inserted between plates 203, 203 of a corresponding holder 201.

Figure 20:
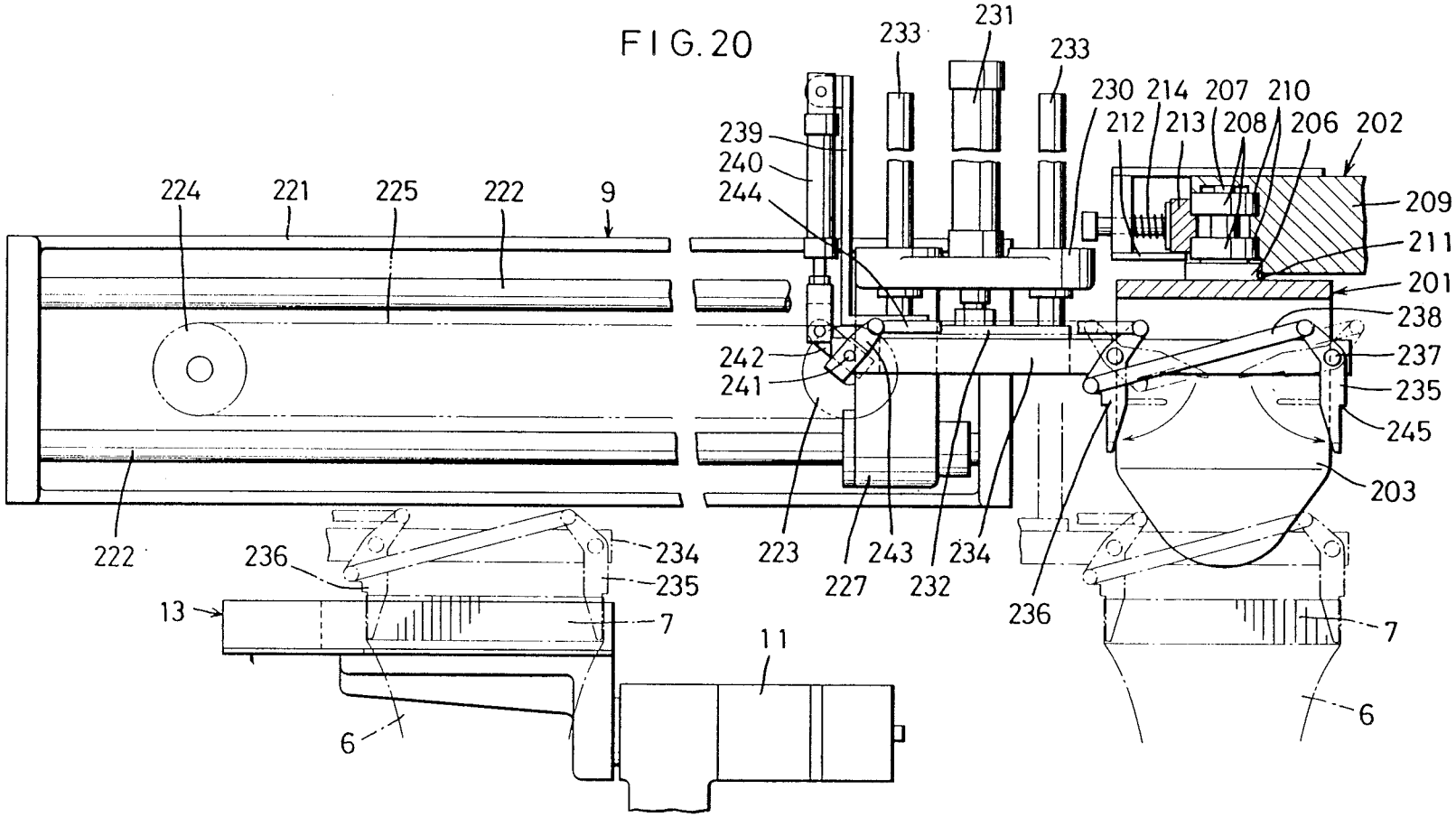
FIG. 20 is a vertical sectional view of a forwarding mechanism and a transfer device of an automatic fitting apparatus according to a second embodiment of the present invention.

As shown in FIG. 20, a pair of claws 235, 236 are provided in such a manner that when they have been swung downwards, the interval between the claws 235, 236 as taken at the outside thereof is slightly wider than width of the plates 203 of a holder 201 so as to spread and hold the welt portion 7 that has been disposed over the plates 203.

When the claws 235, 236 have been swung downwardly, a stepped portion 245 thereof defined at an outer edge of the claws is positioned at the level of projections 205 of the plates 203, whereby an upper hem part of welt portion 7 is positioned on the claws.

After an operator has applied a welt portion 7 of a hose part to a holder 201 at the fitting station of the forwarding mechanism, the holder 201 moves to the delivery position. And, when two holders 201 stop there side by side, running body 227 of transfer device 9 advances, and plates 234, 234 disposed in an elevated position enter holders 201, 201 to receive hose parts when at the delivery position. At this moment, cylinder 240, as shown by the solid line in FIG. 20 is retracted and the claws 235, 236 are swung downward to spread apart and hold both sides of a welt portion 7.

Under this condition, up-and-down moving body 232 moves downward to pull welt portion 7 downward and off of plates 203 with claws 235, 236. The plate 234 and claws 235, 236 can move down within holder 201 without difficulty since plates 203, 203 can be forced open outwardly due to the flexible property thereof.

After plates 234, 234 have moved downwardly, running body 227 is withdrawn to deliver hose part 6 from two holders 201, 201 to table 13. The stopper is released from holder 201 from which the hose part has been pulled out. After an empty holder has moved to the fitting station, the next holder 201 is brought to the delivery position.

Figure 24:
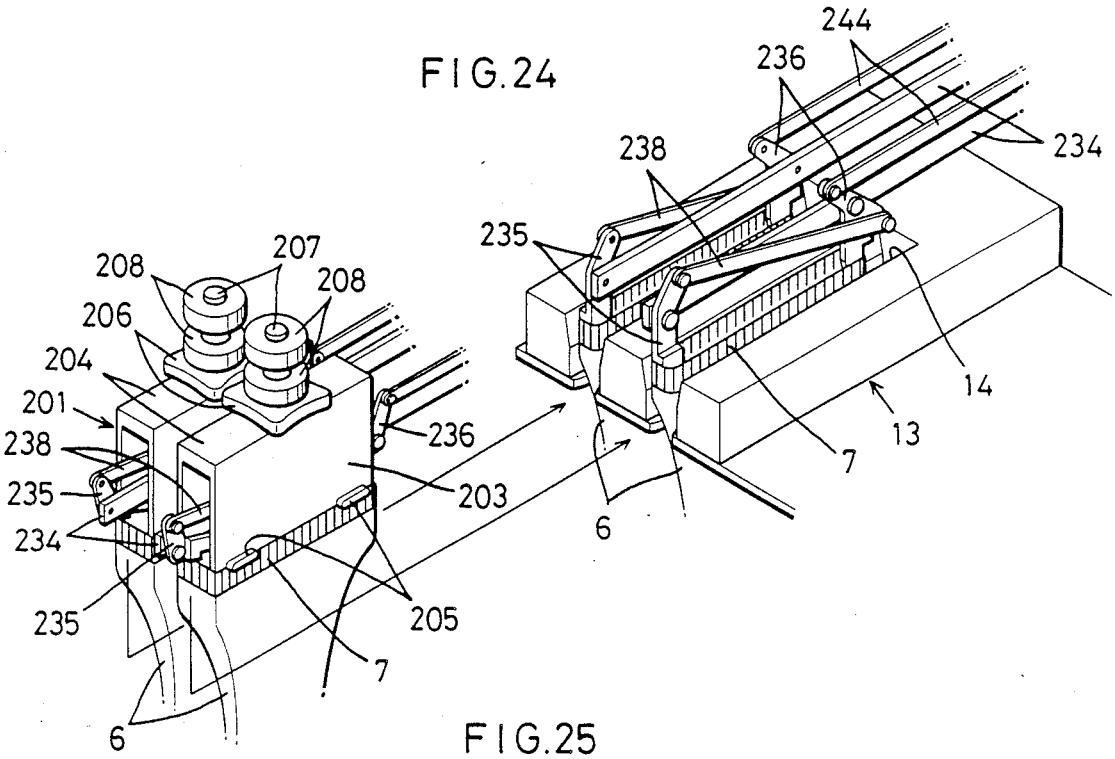
FIG. 24 is a perspective view illustrating the delivery of hose parts by the forwarding mechanism to the transfer device.

When running body 227 has moved to the withdrawn position, a pair of hose parts, retained by claws 235, 236, as shown by the dashed line in FIG. 20 and FIG. 24, have their welt portions inserted into slits 14, 15 defined in the table 13 which is in an upright position to receive the welt portions. The welt portions 7 are sucked at both sides by suction member 18 and suction devices 20, 21.

After this, the extension of cylinder 240 moves claws 235, 236 upwardly so that the claws are removed from welt portions 7 to release the same. Then up-and-down moving body 232 is returned to an elevated position and remains there. As is apparent from the above, by using the forwarding mechanism and transfer device 9 of the second embodiment, a pair of hose parts 6 of pantyhose can be delivered at the same time to the table 13, and yet only a simple task by an operator is required, i.e. disposing a welt portion 7 over a holder 201 from underneath. Thus, using the apparatus requires much less laborious work than the prior art and thus, productivity can be increased.

In addition, the forwarding mechanism in the second embodiment is so constructed that a pair of hose parts 6 received from two holders 201, 201 are, as shown in FIG. 24, supported by claws 235, 236 in a manner in which sides of the welt portions are spread apart so as to be open to the extent of the distance between claws 235, 236. The welt portions 7 are thus so disposed in slits 14, 15 of the moving table 13 that the welt portions 7 are sucked in correct positions by the suction member of the table.

Figure 25:
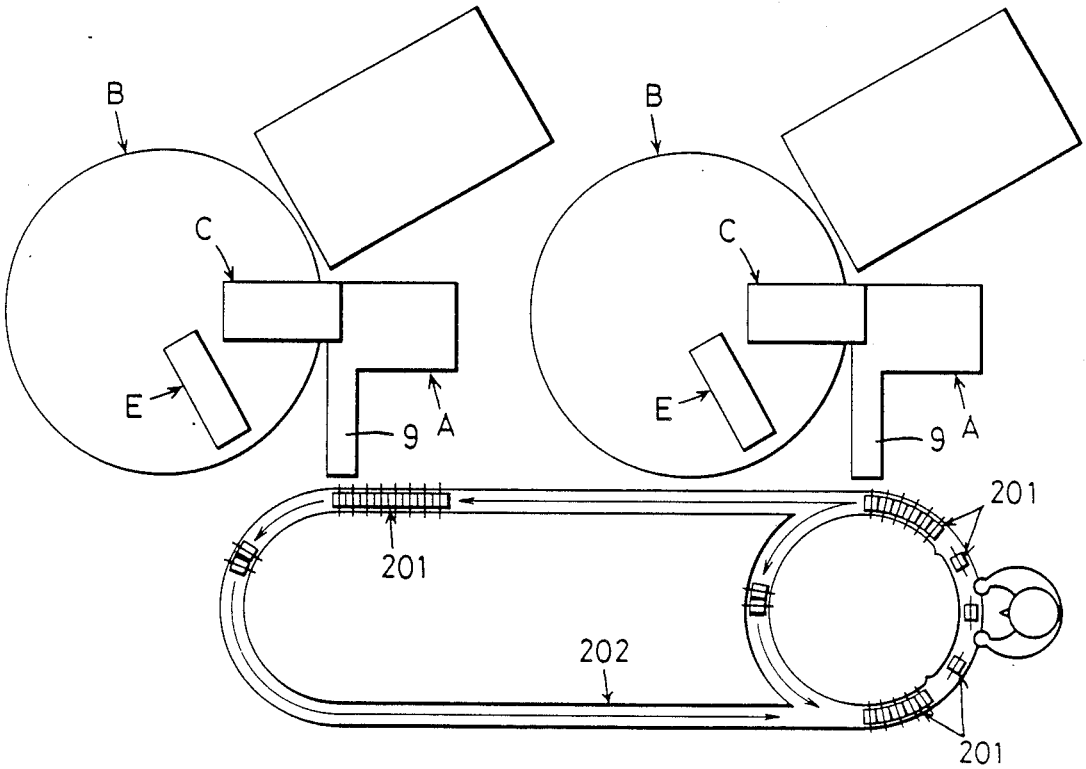
FIG. 25 is a plan view of a system employing a plurality of automatic fitting apparatuses according to the second embodiment of the present invention.

FIG. 25 shows a system in which hose parts 6 are delivered to a plurality of a panty part sewing machine B by the forwarding mechanisms and transfer devices 9 of the second embodiment to increase efficiency.

In this example, an endless conveyor 202 of forwarding mechanism, designed to preliminarily accommodate hose parts 6 on holders 201, is disposed in such a manner as to face each panty part sewing machine B. And, a receiving position is at the location at which the holders 201 face each machine B so that a pair of hose parts 6 can be delivered to each machine B at the same time.

What is claimed is:

1. Apparatus for delivering hose parts of half made pantyhose to a pantyhose finishing machine, said apparatus comprising:

a forwarding mechanism means for holding a hose part of pantyhose at a welt portion thereof and conveying a hose part of pantyhose so held in a forward direction in the apparatus;

a hose part-receiving table disposed in the apparatus to receive hose parts of pantyhose conveyed by said forwarding mechanism, said table defining a pair of slits into which respective hose parts of pantyhose are insertable, said table having a horizontally extending pivot axis about which said table is rotatably mounted in the apparatus, and said table comprising a suction member means extending between said slits for exerting suction to suck portions of hose parts of pantyhose disposed in said slits thereto, and suction device means disposed across each of said slits from said suction member means for also exerting suction to suck other portions of hose parts of pantyhose disposed in said slits thereto;

drive means operatively connected to said table for rotating said table about the pivot axis thereof between upright and sideways positions of the table;

transfer means operatively disposed between said forwarding mechanism means and said hose part-receiving table for transferring hose parts of pantyhose from said forwarding mechanism means into the slits defined in said table when said table is positioned by said drive means in said upright position; and stretching means disposed adjacent said hose part-receiving table for stretching, at the inside of the welt portions thereof, hose parts of pantyhose sucked to said suction member means and said suction device means to grasp the hose parts when said table is positioned at said sideways position thereof by said drive means, and for withdrawing the hose parts so grasped from said table.

2. Apparatus as claimed in claim 1, wherein said forwarding mechanism means comprises a pair of guide plates spaced apart from one another so as to define a slit therebetween extending in said forward direction, and a conveyor comprising an endless belt mounted for rotation in the forwarding mechanism means with a run thereof extending along said slit for conveying hose parts of pantyhose placed in a front end of said slit in said forward direction to a rear end of said slit, and wherein said transfer means is reciprocally movable back and forth between said forwarding mechanism means and said table to transfer hose parts of pantyhose forwarded to the rear of said slit in said forwarding mechanism means into said pair of slits in said table.

3. Apparatus as claimed in claim 2, wherein said table is reciprocally movable between respective positions at which the slits defined therein are each aligned with the slit defined in said table.

4. Apparatus as claimed in claim 1, wherein said forwarding mechanism means comprises a plurality of holders configured to receive and retain welt portions of hose parts of pantyhose thereon, and a conveyor to which said holders are suspended, each of said holders comprising a pair of spaced apart flexible plates confronting one another and having lower ends which extend toward each other, projections extending from the outer surfaces of said plates which define limits at which hose parts of pantyhose are to be disposed over said holders, and bearings and a guide member disposed over said plates, said conveyor comprising a conveyor body having grooves extending therein in said forward direction, said bearings and said guide member being disposed in and guided by said grooves, and a belt pressing said bearings in said grooves against said conveyor body, said belt being drivable in said forward direction to rotate said bearings and move said holders in said forward direction.

* * * * *